US008381453B2

(12) United States Patent
Lim

(10) Patent No.: US 8,381,453 B2
(45) Date of Patent: Feb. 26, 2013

(54) MULTI-STOREY BUILDING DESIGN

(75) Inventor: Tong Kay Lim, Singapore (SG)
(73) Assignee: Tong Kay Lim, Singapore (SG)

( * ) Notice: Subject to any disclaimer, the term of this patent is extended or adjusted under 35 U.S.C. 154(b) by 376 days.

(21) Appl. No.: 12/595,619
(22) PCT Filed: Apr. 8, 2008
(86) PCT No.: PCT/SG2008/000112
§ 371 (c)(1),
(2), (4) Date: Oct. 13, 2009
(87) PCT Pub. No.: WO2008/127198
PCT Pub. Date: Oct. 23, 2008
(65) Prior Publication Data
US 2010/0043324 A1 Feb. 25, 2010
(30) Foreign Application Priority Data
Apr. 13, 2007 (SG) ..... 200702717-0
(51) Int. Cl.
*E04H 9/00* (2006.01)
(52) U.S. Cl. ..... 52/79.2
(58) Field of Classification Search ..... 52/79.2, 52/79.3, 234, 236.3, 236.4, 236.7
See application file for complete search history.

(56) References Cited

U.S. PATENT DOCUMENTS

| | | | | | |
|---|---|---|---|---|---|
| 3,479,781 | A | * | 11/1969 | Johnson | 52/169.3 |
| 3,503,170 | A | * | 3/1970 | Shelley | 52/79.2 |
| 3,710,534 | A | * | 1/1973 | McNamara, Jr. | 52/745.03 |
| 3,750,354 | A | * | 8/1973 | Boros | 52/236.4 |
| 3,805,461 | A | * | 4/1974 | Jagoda | 52/79.11 |
| 4,918,889 | A | * | 4/1990 | Lundstrom et al. | 52/234 |
| 5,528,866 | A | * | 6/1996 | Yulkowski | 52/79.12 |
| 2003/0101680 | A1 | * | 6/2003 | Lee | 52/745.2 |
| 2004/0221519 | A1 | * | 11/2004 | Zwimpfer | 52/79.1 |

FOREIGN PATENT DOCUMENTS

| | | | | |
|---|---|---|---|---|
| CN | 1651698 | A | | 8/2005 |
| EP | 0467191 | A1 | | 1/1992 |
| JP | 06173473 | A | * | 6/1994 |
| JP | 2006037649 | A | | 2/2006 |

* cited by examiner

*Primary Examiner* — Christine T Cajilig
(74) *Attorney, Agent, or Firm* — The Webb Law Firm

(57) ABSTRACT

A multi-storey building according to the invention has a plurality of intermediate stacks and each intermediate stack connects to the next intermediate stack adjacently by a plurality of sky terraces. The plurality of sky terraces is alternately disposed at successive stories.

20 Claims, 4 Drawing Sheets

MULTI-STOREY BUILDING DESIGN

RELATED APPLICATIONS

This patent application is a National Stage of International Application Serial No. PCT/SG2008/000112, filed Apr. 8, 2008, which claims the benefit of Singapore Application Serial No. 200702717-0, filed on Apr. 13, 2007, the disclosures of which are all incorporated herein by reference in their entireties.

FIELD OF INVENTION

This invention relates to an architectural design for vertical stacking of sky terraces in a multi-storey building for all building types.

BACKGROUND OF THE INVENTION

City Planners have always been concerned about the sustainability of urban development, which is full of concrete buildings, air-conditioners, roads and road traffic but deprived of trees and gardens to give a balance to the built-up environment. The well-known phenomenon of an "urban heat sink" describes the growing increase in environmental temperature of cities over its surrounding areas.

Traditionally, multi-storey buildings were built with maximum saleable "private" space with little or no communal space for greenery. In recent years, some buildings incorporate small pockets of sky terraces with greenery in apartments or commercial buildings. A sky terrace is defined as a communal or landscaping area within a multi-storey building that must be accessible from common areas. An "effective area" is defined as the floor area covered under a 45 degree line from the top of an open perimeter wall that allows sunlight through. Only such area is considered a sky terrace.

For greenery to grow effectively, the sky terraces should be built to a height of around 5 meters or more with as much of its perimeter walls open. As habitable units are normally 3.3 meters in height, a two-storey void would need to be set aside for each sky terrace. Repeating these two conditions of design into several sky terraces and achieving modularity of the habitable units poses a great challenge for designers. Accordingly, buildings are now built with one or two mid level sky terraces and the sky terraces are confined to limited deck space.

In view of the foregoing, it is desirable to provide a multi-storey building that can allow each habitable unit access to a sky terrace(s) and increase the percentage of open perimeter walls, while achieving modularity of the habitable units.

SUMMARY OF INVENTION

According to one embodiment of the present invention, a multi-storey building comprising:

- a plurality of intermediate stacks;
- a plurality of sky terraces connecting one intermediate stack to another intermediate stack;

and at least one intermediate stack adjoins between two plurality of sky terraces. Each storey of an intermediate stack further comprises at least one habitable unit.

The multi-storey building further comprises a plurality of corner stacks. At least one corner stack adjoins to one plurality of sky terraces. Each storey in a corner stack comprises at least one habitable unit.

The plurality of sky terraces according to the present invention are vertically spaced apart by at least two stories.

The multi-storey building further comprises a plurality of sky terraces on one side of each intermediate stack and is disposed alternately at a lower or a higher storey relative to a plurality of sky terraces disposed on an other side of the same intermediate stack. This arrangement is repeated vertically.

Each habitable unit according to the present invention preferably includes a side that allows direct access to the sky terraces and at least one side that has windows. One of the sides of the habitable unit that has windows opens to a terrace at a lower storey.

Further, the layout of the plurality of stacks and the plurality of sky terraces according to the present invention can be arranged in a linear configuration or a non-linear configuration. The sky terraces are accessible directly by staircases or lifts.

According to another embodiment of the present invention, the multi-storey building comprises corner stacks where the most remote habitable unit can be a two-stories unit or can be left void altogether. The upper storey of a two-stories unit can also be a void.

According to yet another embodiment of the present invention, the plurality of sky terraces may also connect one intermediate stack to another intermediate stack to form a closed loop configuration.

According to yet another embodiment of the present invention, a multi-storey building comprising:

- a first plurality of sky terraces;
- a second plurality of sky terraces; and
- an intermediate stack connecting the first and the second plurality of sky terraces.

The first and the second plurality of sky terraces are disposed on different stories.

The first and the second plurality of sky terraces are preferably alternately disposed at successive stories.

The first plurality of sky terraces is vertically spaced from one another by at least two stories.

The intermediate stack further comprises a plurality of habitable units, each having a first side adjoining one of the first plurality of sky terraces, and a second side vertically spaced apart from one of the second plurality of sky terraces by at least one storey.

According to another embodiment of the present invention, the intermediate stack may also connect the first and the second plurality of sky terraces to form a closed loop configuration.

DETAILED DESCRIPTION OF INVENTION

The present invention is expected to yield more effective areas for sky terraces. This is achieved by planning sky terraces with spacing of at least two-stories apart. This can yield effective areas twice as much as those sky terraces that are spaced one-storey apart. As sky terraces are attractive areas that can enhance the selling price of the units, much in excess of its cost of construction, such inclusion can greatly enhance the profit of the development.

The present invention is a design of a multi-storey building where each intermediate stack or each corner stack comprises one habitable unit or several habitable units in one stack. A habitable unit is any building type such as apartments, offices, commercial or industrial spaces. The stacks (10) and the sky terraces (12) may be arranged in a straight row or in any irregular arrangements. That means the stacks (10) and the sky terraces (12) can be arranged in a linear configuration or in a non-linear configuration.

Figure 1:
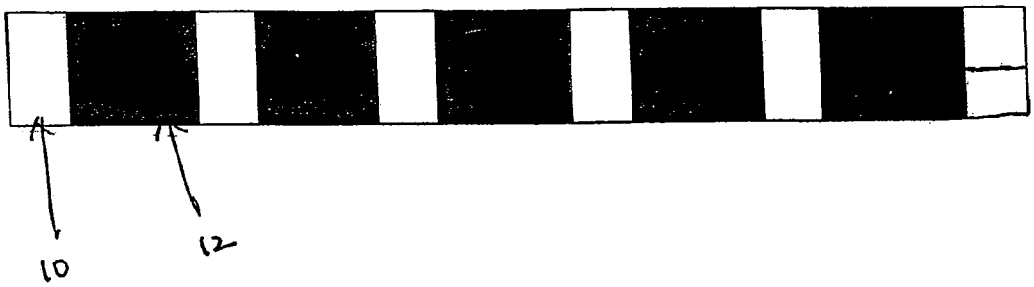
FIG. 1 is a plan view of concatenating intermediate and corner stacks and plurality of sky terraces into a straight chain.
Figure 2:
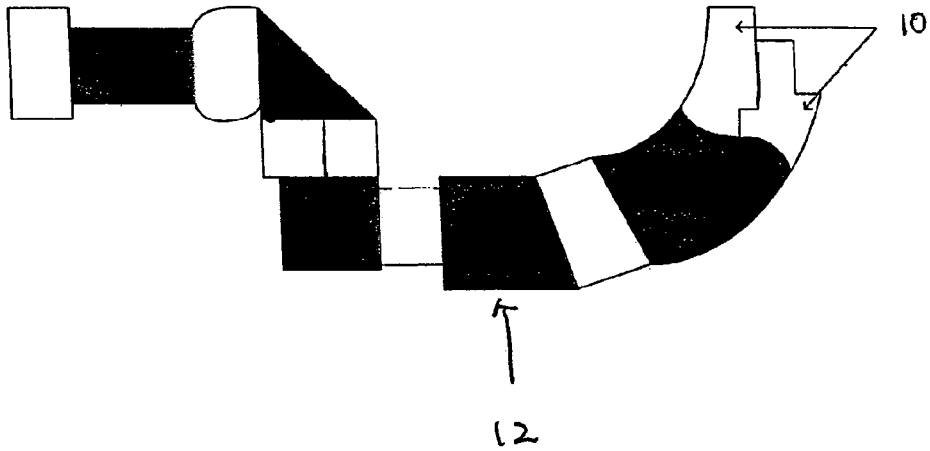
FIG. 2 is a plan view of concantenating intermediate and corner stacks and plurality of sky terraces into a chain arranged into any form, in any shapes and sizes, i.e., in a linear configuration or a non-linear configuration.

In FIG. 1, there is shown a plan view of concatenating stacks (10) and plurality of sky terraces (12) into a straight chain/row with regular right angle turns, i.e., in a linear configuration, while FIG. 2 shows a plan view of concantenating stacks (10) and plurality of sky terraces (12) into a chain arranged into any form, in any shapes and sizes, including shapes resembling letters U, L, O, S, V, J and so on, with right or oblique angles at any point along the building block, i.e., in a non-linear configuration.

Figure 3:
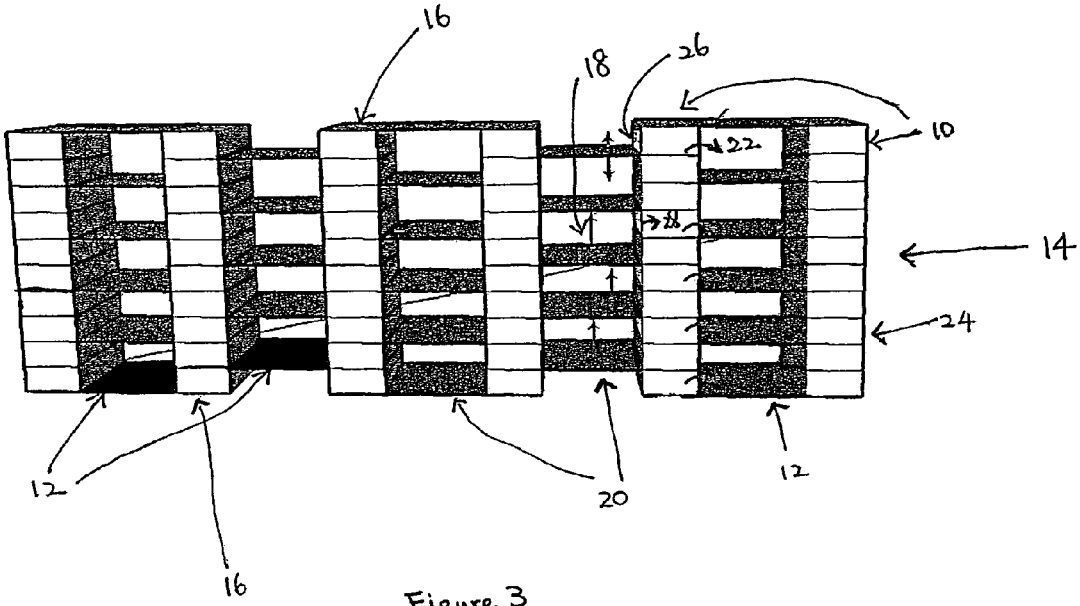
FIG. 3 is a perspective view of a multi-storey building with concatenating intermediate and corner stacks and alternately staggered plurality of sky terraces.

In one embodiment of the present invention, as shown in FIG. 3, a multi-storey building (14) comprises of a plurality of sky terraces (12) and a plurality of intermediate stacks (16). Each intermediate stack (16) connects to the next intermediate stack (16) by a plurality of sky terraces (12) such that at least one intermediate stack (16) adjoins between two plurality of sky terraces (12). The plurality of sky terraces (12) are vertically spaced apart from one another by at least two-stories (18) to achieve lofty sky terraces.

The plurality of sky terraces (12) on one side of an intermediate stack (16) is disposed alternately at a lower or a higher storey (20) relative to the plurality of sky terraces (12) disposed on an other side of the same intermediate stack (16). The plurality of sky terraces (12) are alternately disposed at successive stories (20). This arrangement of the sky terraces (12) and the intermediate stacks (16) is repeated vertically.

This allows all habitable units in an intermediate stack (16) to each gain direct access to a sky terrace (12) on the same storey adjoining to the habitable units (22). The habitable units above and below will access the sky terraces on opposite sides.

The multi-storey building (14) of the present invention further comprises a plurality of corner stacks (24) where at least one corner stack (24) adjoins to one plurality of sky terraces (12). Habitable units in a corner stack (24) can be specially designed to be a one or two storey units. In doing so, modularity is achieved for all the habitable units in the intermediate stacks and half the habitable units in the corner stacks.

Further, a building as described allows each habitable unit to include at least one side for windows (26) and a side to access to a sky terrace (12). One of the window sides (28) can open the window to view a sky terrace at a lower storey. This helps to achieve privacy, ventilation and lighting, while enjoying the garden view.

Further, a building as described can have staircases and/or lifts directly to the sky terraces to ensure communal access.

Figure 4:
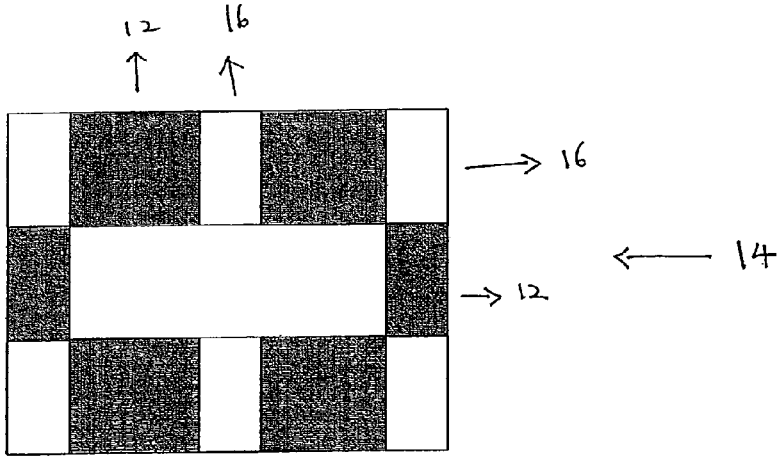
FIG. 4 is a plan view of a multi-storey building having plurality of sky terraces which connect one intermediate stack to the next intermediate stack to form a closed loop configuration.

In another embodiment of the present invention, as shown in FIG. 4, a multi-storey building (14) having a plurality of sky terraces (12) connect one intermediate stack (16) to another or the next intermediate stack (16) adjacently to form a closed loop configuration. For instance, two plurality of sky terraces and two intermediate stacks can form a closed loop configuration. In such an embodiment, there are no corner stacks.

Figure 5:
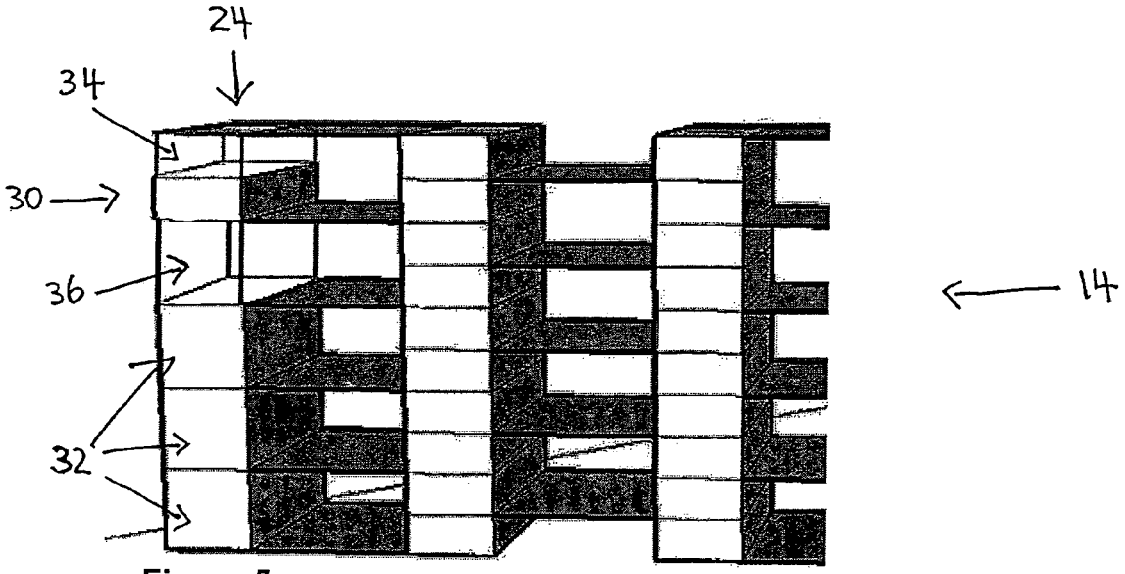
FIG. 5 is a perspective view of a multi-storey building where the most remote habitable unit of the corner stacks is a two-stories unit or the upper storey of the habitable unit is a void or the habitable unit is a void altogether.

In another embodiment of the present invention, as shown in FIG. 5, the most remote habitable unit (30) of a corner stack (24) in a multi-storey building (14) is a two-stories unit (32). The upper storey (34) of that habitable unit (30) can also be a void. The most remote habitable unit (30) can also be a void altogether (36).

Figure 6:
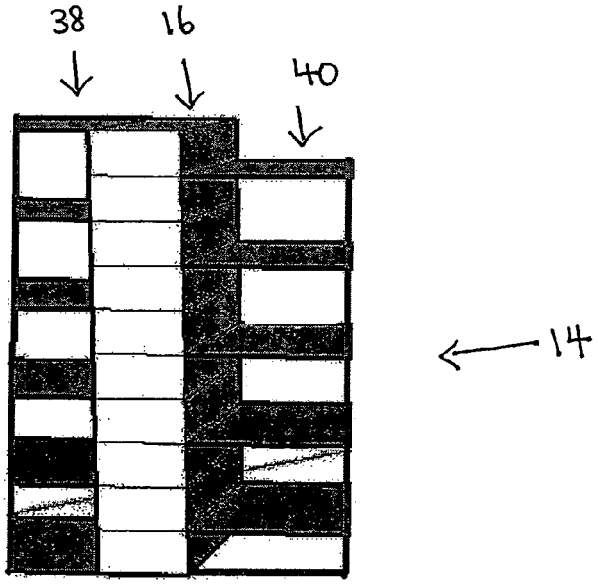
FIG. 6 is a perspective view of a multi-storey building where the sky terraces are alternately disposed on different stories.

In yet another embodiment of the present invention, as shown in FIG. 6, a multi-storey building (14) comprises of a first plurality of sky terraces (38) and a second plurality of sky terraces (40). The multi-storey building further comprises an intermediate stack (16) connecting the first (38) and the second plurality of sky terraces (40). The first (38) and the second plurality of sky terraces (40) are disposed on different stories. The first plurality of sky terraces (38) is disposed on the one side while the second plurality of sky terraces (40) is disposed on the other side.

The first (38) and the second (40) plurality of sky terraces are preferably alternately disposed at successive stories. The first plurality of sky terraces (38) is vertically spaced from one another by at least two stories.

The intermediate stack further comprises a plurality of habitable units. Each habitable unit has a first side which adjoins to one of the first plurality of sky terraces (38). The habitable unit further has a second side vertically spaced apart from one of the second plurality of sky terraces (40) by at least one storey.

The intermediate stack may also connect the first and the second plurality of sky terraces to form a closed loop configuration.

Figure 7:
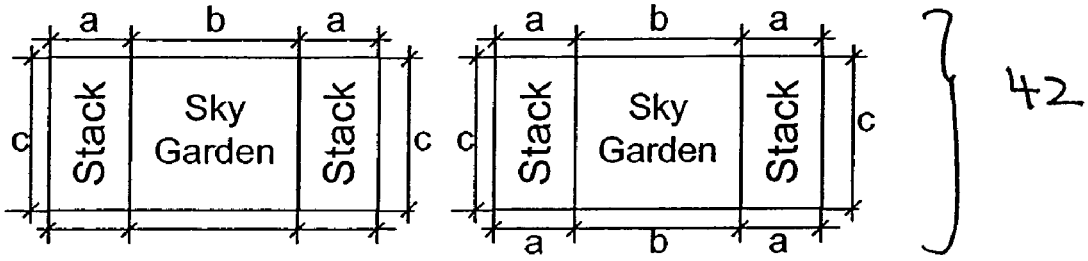
FIG. 7 is a plan view showing a conventional building with only one sky terrace with greenery in an intermediate storey.
Figure 8A:
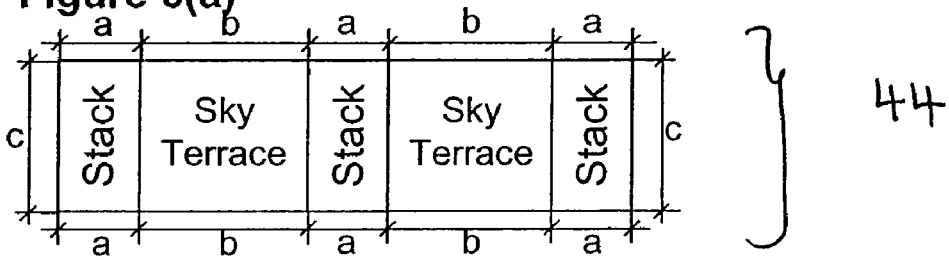
FIGS. 8(*a*) and (*b*) are plans views showing arrangement of concantenating stacks and a plurality of sky terraces with increasing open perimeter walls.
Figure 8B:
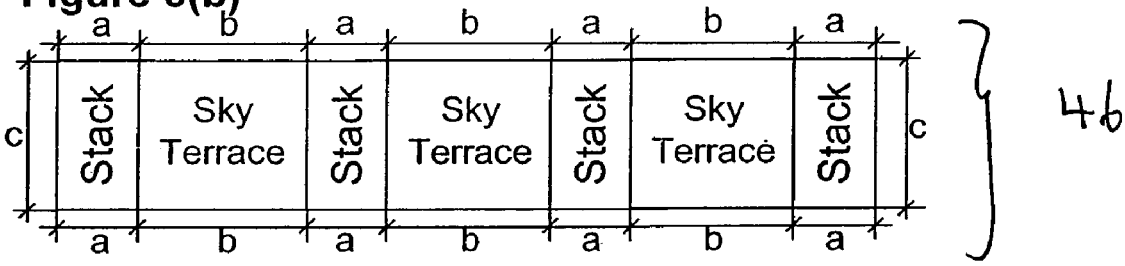

FIGS. 7-8 provide examples to show the increase in percentage of open perimeter walls from the present invention is achievable. FIG. 7 shows a conventional building with only one sky terrace with greenery in an intermediate storey (42). In the figure, "a" and "c" are defined as the close side perimeter wall and close main perimeter wall respectively. There are eight close side perimeter walls and four close main perimeter walls.

In the figure, "b" is defined as an open perimeter wall and there are four open perimeter walls. The percentage of open perimeter walls is thus:

$$\frac{\text{Open perimeter walls}}{\text{Total perimeter walls}} = \frac{4\times b}{(4\times b+8\times a+4\times c)}\times 100\% = \frac{b}{(b+2\times a+c)}\times 100\%$$

FIG. 8(*a*) shows an arrangement of concantenating stacks and a plurality of sky terraces with increasing open perimeter walls (44). There are six close side perimeter walls ("a"), four close main perimeter walls ("c") and four open perimeter walls ("b"). The percentage of open perimeter walls is thus:

$$\frac{\text{Open perimeter walls}}{\text{Total perimeter walls}} = \frac{4\times b}{(4\times b+6\times a+4\times c)}\times 100\% = \frac{b}{\left(b+1\frac{1}{2}\times a+\frac{1}{2}\times c\right)}\times 100\%$$

FIG. 8(*b*) shows yet another arrangement of concantenating stacks and a plurality of sky terraces with increasing open perimeter walls (46). There are eight close side perimeter walls ("a"), two close main perimeter walls ("c") and six open perimeter walls ("b"). The percentage of open perimeter walls is thus:

$$\frac{\text{Open perimeter walls}}{\text{Total perimeter walls}} = \frac{6\times b}{(6\times b+8\times a+2\times c)}\times 100\% = \frac{b}{\left(b+1\frac{1}{4}\times a+\frac{1}{3}\times c\right)}\times 100\%$$

From the above, it can be seen that FIGS. 7-8 have the same numerator. But FIG. 8(*a*) has a smaller denominator than that in FIG. 7 and FIG. 8(*b*) has an even smaller denominator than that in FIG. 8(*a*). This proves that as more stacks and sky terraces are added, a higher percentage of open perimeter walls is achievable.

Building types represented in FIGS. 8(*a*) and (*b*) concatenate all stacks and sky terraces into a contiguous chain and allows intermediate stacks. The building types allows almost equal lighting and ventillation compared to the conventional separated stacks. The concatenation eliminates the inclusion of the length of open window walls (referred to as a close main perimeter wall "c") of an intermediate stack from the total perimeter walls. This helps in intensifying the implementation of sky terraces.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A multi-storey building comprising:

a plurality of intermediate stacks; and sky terraces concatenating one intermediate stack of the plurality of intermediate stacks and another intermediate stack of the plurality of intermediate stacks; wherein at least one sky terrace is a communal or landscaping area accessible from common areas within the multi-storey building, at least one of the intermediate stacks concatenate a first plurality of sky terraces and a second plurality of sky terraces, the first plurality of sky terraces are vertically spaced apart from one another by at least two stories, and the first and second plurality of sky terraces are disposed on different stories;

wherein a storey of the intermediate stack further comprises one or more habitable units, with at least one habitable unit on the first side of the stack which adjoins to one of the first plurality of sky terraces, and at least one habitable unit on the second side of the stack which adjoins to one of the second plurality of sky terraces, the first and second sides being vertically spaced apart by at least one storey.

2. A multi-storey building according to claim 1, wherein one storey of the one intermediate stack comprises at least one habitable unit.

3. The multi-storey building according to claim 1 further comprising a plurality of corner stacks, wherein at least one corner stack adjoins to one of the first and second plurality of sky terraces.

4. A multi-storey building according to claim 3, wherein one storey of the at least one corner stack comprises at least one habitable unit.

5. The multi-storey building according to claim 1, wherein the first plurality of sky terraces on one side of the one intermediate stack is disposed alternately at a lower or a higher storey relative to the second plurality of sky terraces disposed on another side of the same intermediate stack.

6. The multi-storey building according to claim 5, wherein the first plurality of sky terraces is provided on one side of the one intermediate stack and disposed alternately at a lower or a higher storey relative to the second plurality of sky terraces disposed on another side of the same intermediate stack, this arrangement being repeated vertically.

7. The multi-storey building according to claim 3, wherein a most remote habitable unit of the at least one corner stack is a two-stories unit.

8. The multi-storey building according to claim 7, wherein an upper storey of the most remote habitable unit of the at least one corner stack is a void.

9. The multi-storey building according to claim 3, wherein a most remote habitable unit of the at least one corner stack is a void.

10. The multi-storey building according to claim 1, wherein the first plurality of sky terraces connecting the one intermediate stack to another intermediate stack form a closed loop configuration.

11. The multi-storey building according to claim 2, wherein the at least one habitable unit includes at least one side for windows.

12. The multi-storey building according to claim 11, wherein one of the sides for windows opens to a sky terrace at a lower storey.

13. The multi-storey building according to claim 2, wherein the at least one habitable unit includes a side to access the sky terraces.

14. The multi-storey building according to claim 1, wherein the plurality of intermediate stacks, the first and second plurality of sky terrace are arranged in a linear configuration.

15. The multi-storey building according to claim 1, wherein the plurality of intermediate stacks, the first and second plurality of sky terraces are arranged in a non-linear configuration.

16. The multi-storey building according to claim 1, wherein the first plurality of sky terraces are accessible by staircases or lifts.

17. The multi-storey building according to claim 1, wherein the first and the second plurality of sky terraces are alternately disposed at successive stories.

18. The multi-storey building according to claim 1, wherein the second plurality of sky terraces are vertically spaced apart from one another by at least two storeys.

19. A multi-storey building comprising:

a plurality of intermediate stacks; and sky terraces concatenating one intermediate stack of the plurality of intermediate stacks and another intermediate stack of the plurality of intermediate stacks; wherein at least one sky terrace is a communal or landscaping area accessible from common areas within the multi-storey building, at least one of the intermediate stacks concatenate a first plurality of sky terraces and a second plurality of sky terraces, the first plurality of sky terraces are vertically spaced apart from one another by at least two stories, and the first and second plurality of sky terraces are disposed on different stories;

wherein at least one corner stack adjoins to one of the first and second plurality of sky terraces, wherein a most remote habitable unit of the at least one corner stack is a two-stories unit, and wherein an upper storey of the most remote habitable unit of the at least one corner stack is a void.

20. A multi-storey building comprising:

a plurality of intermediate stacks; and sky terraces concatenating one intermediate stack of the plurality of intermediate stacks and another intermediate stack of the plurality of intermediate stacks; wherein at least one sky terrace is a communal or landscaping area accessible from common areas within the multi-storey building, at least one of the intermediate stacks concatenate a first plurality of sky terraces and a second plurality of sky terraces, the first plurality of sky terraces are vertically spaced apart from one another by at least two stories, and the first and second plurality of sky terraces are disposed on different stories, wherein at least one corner stack adjoins to one of the first and second plurality of sky terraces, and wherein a most remote habitable unit of the at least one corner stack is a void.

* * * * *